United States Patent [19]

Heckenhauer et al.

[11] 4,154,481

[45] May 15, 1979

[54] ROAD PLANER WITH IMPROVED CUTTING DRUM SUSPENSION

[75] Inventors: William G. Heckenhauer; Robert E. Loy, both of Bucyrus, Ohio

[73] Assignee: Dresser Industries, Inc., Dallas, Tex.

[21] Appl. No.: 823,902

[22] Filed: Aug. 12, 1977

[51] Int. Cl.[2] ..... E01C 23/12

[52] U.S. Cl. ..... 299/39; 172/484

[58] Field of Search ..... 172/788, 789, 791, 781, 172/795, 796, 797, 488, 699, 484; 299/39

[56] References Cited

U.S. PATENT DOCUMENTS

| | | | |
|---|---|---|---|
| 3,072,391 | 1/1963 | McDarrah | 299/39 |
| 3,444,936 | 5/1969 | Page et al. | 172/795 |
| 3,534,817 | 10/1970 | Garis et al. | 172/484 |
| 3,606,467 | 9/1971 | Christensen et al. | 299/39 |
| 3,631,931 | 1/1972 | Frisbee | 172/484 |
| 3,976,146 | 8/1976 | Desourdy | 172/791 |

FOREIGN PATENT DOCUMENTS

| | | | |
|---|---|---|---|
| 2139937 | 2/1973 | Fed. Rep. of Germany | 172/796 |

*Primary Examiner*—William Pate, III

*Attorney, Agent, or Firm*—John M. Lorenzen

[57] ABSTRACT

The invention is a better road planing vehicle having an improved suspension system for supporting the rotary cutting unit under the vehicle chassis. The suspension includes a pair of lift and tilt cylinders connected in parallel spaced relation at one end to the vehicle frame and at the other end to the top of the cutter housing. Three parallel and triangularly arranged drawbars are connected at one end to the cutter housing and extend either fore or aft to connect at their other ends with the vehicle frame. A sideshift cylinder is connected between the frame and one of the drawbars. In the preferred embodiment the connections of the lift cylinders and the drawbars are ball joints.

7 Claims, 6 Drawing Figures

ROAD PLANER WITH IMPROVED CUTTING DRUM SUSPENSION

The invention relates to road planing vehicles, and more particularly to an improved suspension for supporting the rotary cutting unit under the vehicle chassis.

Machines for removing worn, damaged, or uneven surfaces from paved roadways, bridges, airport runways and the like, frequently in preparation for repaving the same, have been known for some years. Most of the earlier machines, and some of the present ones, first apply heat to the surface to soften the paving material before cutting or scraping it off. More recently, planers have been developed with rotary pick-carrying drums which are capable of cutting or milling away a layer of aggregate-filled asphalt, concrete, or the like without first applying heat. Although the invention has application to both types of planers, it will be discussed hereinafter in relation to the latter type.

There are assorted designs of cold planers, but most include a vehicle adapted to travel along the work surface with a rotating cutting drum suspended underneath it. The rotary drum is usually laced with picks or bits having hardened tips which mill the surface as the planer advances. A typical planer of this type is shown and described in U.S. Pat. No. 4,006,936.

The prior art planers have used various means for suspending and supporting the cutting unit under the vehicle chassis. In most cases the cutting drum can be adjusted vertically to control the depth of cut and tilted along its axis to follow the crown of the roadway. In addition, on many of the machines the drum can also be shifted transversely to the direction of travel to facilitate adjusting the cut with respect to the centerline of the machine or outside the vehicle wheels to cut along curbs, manholes, or other obstacles.

However, no prior suspension systems have been entirely satisfactory, primarily from the standpoint that when making one desired adjustment of the cutting drum the operator is usually required to make additional adjustments to correct changes in other parameters. In addition, some of the systems are unduly complex and cumbersome, and sometimes make longer vehicle wheel bases necessary. Still others interfere with accessibility to the cutting drum for replacement, repair or servicing. And finally, the prior suspension systems leave room for improvement in their ability to control the attitude of the cutting unit throughout the various adjusted positions with sufficient accuracy to make the use of automatic slope and grade controls more dependable.

It is therefore the principal object of the present invention to provide a better road planer having an improved system for suspending the rotary cutting unit under the vehicle chassis.

It is a more specific object of the invention to provide a road planer in which the cutting unit is suspended from the vehicle chassis in such a manner that the proper orientation of the cutter and cutter housing is maintained whenever the cutter is raised, lowered, tilted, or side shifted, and such that automatic grade and slope controls can be effectively used in cooperation with the cutting unit.

Finally, it is also an object of the invention to provide a cutting unit suspension for road planers which minimizes the number of adjustments the operator must make to position the cutting unit for optimum cutting, and which is simple and allows easy access to the cutting unit for service or replacement.

These and other objects are achieved by a planer embodying the invention as shown in the accompanying drawings and as described below. The planer is typical insofar as it consists of a vehicle chassis mounted on wheels or the like and has a rotary cutting unit carried under the chassis, preferably between the front and rear wheels. The cutting unit is also preferably a drum laced with cutting bits and rotatably mounted in a housing on an axis which is horizontal and generally perpendicular to direction of travel of the vehicle. The cutter is hydraulically driven by a hydraulic system powered by the vehicle's engine.

However, unlike the prior art road planers, this one includes an improved system for suspending the cutting unit. The cutting unit is principally supported under the chassis frame by two parallel lift cylinders. The cylinders are pivotably mounted on the frame and have their rod ends pivotably connected to the top of the drum housing at spaced positions along its length. Three drawbars are each connected at one end to the housing and at the other end to a position on the frame either fore or aft of the cutting unit. The three drawbars are parallel to each other but are arranged in a triangular pattern so that only two of the three lie in any given common plane. Finally, a side shift cylinder is connected between the frame and one of the drawbars. The connections between the lift cylinders and the drum housing and the connections at both ends of the drawbars are preferably all ball joints, or at least joints allowing substantially universal motion.

The two lift cylinders are effective when actuated to raise or lower the cutting unit to adjust the depth of the cut, to lift the cutting unit clear of the road surface for travel between job sites, or to tilt the axis of the cutting drum to accommodate any lateral slope in the work surface. With respect to any of these movements two of the three drawbars co-operate to maintain the drum housing from rotating about the drum axis.

The side-shift cylinder is effective when actuated to move the cutting unit sideways of the machine. With respect to this adjustment a different pair of the drawbars co-operate to maintain the drum axis perpendicular to the direction of travel of the machine.

This suspension system not only assists the operator in making and maintaining adjustments to the position of the cutting unit, but it also offers other advantages. Since the attitude of the drum housing is fixed with respect to the drum axis and therefore with the planed surface, grade and slope control devices can be mounted on the housing for use with more accurate results. Furthermore, with the components of the suspension system arranged as in the preferred embodiment discussed below, one side of the housing is left unobstructed for easy access to the cutting drum and picks.

Additional features of the invention, as well as numerous modifications and alternative embodiments, will occur to those skilled in the art who read the more detailed description which follows with reference to the accompanying drawings, of which:

Figures 1, 2, 3:
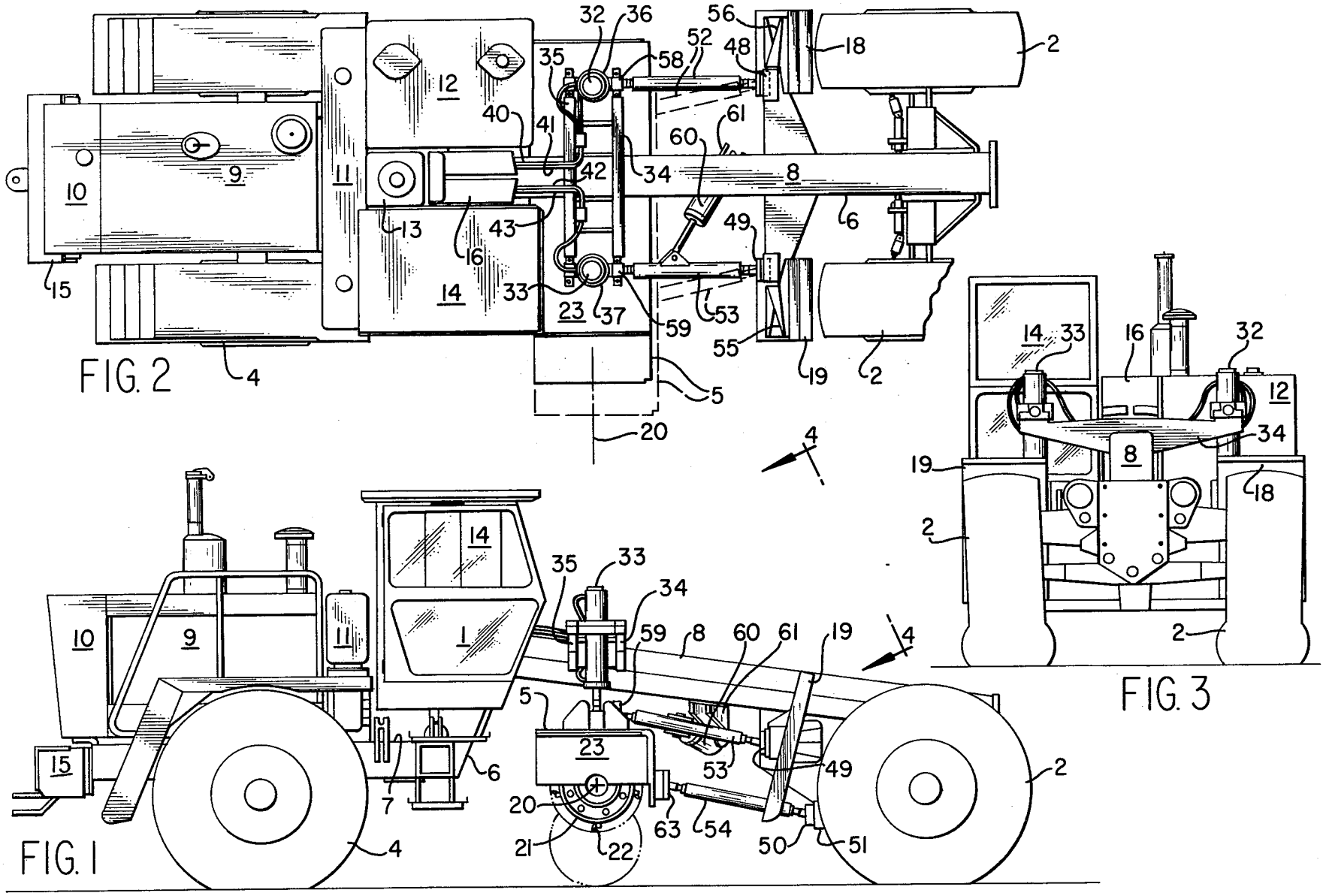
FIG. 1 is a side elevation of a road planing machine made in accordance with the invention.
FIG. 2 is a plan view looking down on the road planing vehicle of FIG. 1.
FIG. 3 is a front elevation view of the road planing vehicle of FIG. 1.

The road planer shown in these drawings comprises a vehicle chassis 1 mounted on front and rear wheels 2 and 4, respectively, although other ground engaging support means, such as crawlers, can be used on some models. The cutting unit 5 is frequently, and in this case preferably, carried under the chassis between the front and rear wheels. Although the cutting unit 5 is shown generally centered between the front and rear wheels, its exact location is determined by such factors as the overall weight distribution of the chassis, and by its visibility to the operator.

The chassis 1 includes a frame 6 which on this particular vehicle is similar to the frames used on motor graders. The frame includes a platform 7 supported by a rectangular structure of box channel members, and a gooseneck section 8 extending forwardly along the centerline of the vehicle.

The frame platform supports various components of the vehicle including the engine 9, the radiator 10, the fuel tank 11, a water tank 12, the hydraulic oil tank 13, the operator's compartment 14, the battery box 15, and the hydraulic system 16. The gooseneck section 8 of the frame supports the cutting unit 5 as will be discussed further below.

The cutting unit itself will vary on different models of road planers, but as shown in FIGS. 1-4 comprises a drum 21 laced with cutting picks or bits 22 having hardened cutting tips. The drum is rotatably mounted in a housing 23 on suitable bearings which are not shown. The axis of rotation 20 of the drum 21 is generally horizontal and perpendicular to the direction of travel or centerline of the chassis 1. A hydraulic motor 24 can be located either inside or outside the housing 23 as desired, and is connected to the hydraulic system 16 by hoses 27, 28, and 29.

On this particular machine the hydraulic system is powered by the same engine 9 which propels the vehicle, but some road planers may use a separate engine for the cutting unit. It is apparent that other types of drives, such as electric or mechanical, could also be used to power the cutting drum. A more detailed description of a typical cutting unit 5 can be found in the aforementioned U.S. Pat. No. 4,006,036.

The cutting unit 5 is principally supported from the gooseneck section 8 of the frame 6 by hydraulic lift cylinders 32 and 33. The lift cylinders are mounted on opposite sides of the frame 6 between a pair of laterally extending brackets 34 and 35 on trunnions 36 and 37 such that they can pivot in any direction. As shown, the trunnions 36 and 37 are located centrally of the bodies of the cylinders 32 and 33 respectively. The cylinders are connected to the hydraulic system by hoses 40, 41, 42, and 43 as shown. The piston rods 38 and 39 of the cylinders 32 and 33 extend downward and are provided at their ends with sockets 44 and 45 which connect to ball connections 46 and 47 mounted on top of the drum housing 23. The ball connections 46 and 47 are spaced the same distance as the trunnions 36 and 37. Therefore, so long as they are extended the same length, the lift cylinders 32 and 33 are in all positions parallel to each other.

The lift cylinders 32 and 33 can be actuated, either simultaneously or independently, to raise the cutting unit clear of the work surface for general travel as shown in FIG. 1, to lower it into the work position as shown by the dotted outline in FIG. 1, to vary or control the depth of the cut, or to tilt the cutting unit along its axis to cut parallel to an inclined surface, such as a crowned roadway.

Control of the orientation of the cutting unit, apart from the aforementioned adjustments, is provided by three parallel drawbars referred to respectively hereafter as the left drawbar 52, the right drawbar 53 (as viewed from the operator's cab), and the lower or center drawbar 54. The three drawbars all have a ball at each end. The left drawbar 52 is connected at one end to a socket 48 on bracket 56 which extends from the frame 6 behind the left wheel fender 18, and at its other end to a socket 58 on the top of the cutting drum housing near the connection of the left lift cylinder 32. Similarly, the right drawbar 53 is connected at one end to a socket 49 on the forward bracket 55 behind fender 19, and at its other end to a socket 59 on the housing 23 near the connection of the right lift cylinder 33. The lower drawbar 54 is connected at its forward end to a socket 50 on a bracket 51 extending down from the frame 6 and at its other end to a socket 63 on the front wall of the housing 23 near the lower center thereof.

All of the connections at the ends of the drawbars should be of a design to allow universal motion, and as mentioned are preferably ball joint connections.

A side-shift cylinder 60 is also provided to effect adjustment of the cutting unit 5 lateral to the direction of travel. Such adjustment allows positioning of the cutting unit 5 to cut beyond the wheels at one side or the other of the planer, such as when cutting along curbs or the like. The cutting unit is of course normally retracted within the ground plan of the vehicle wheels for travel between jobs. The cylinder 60 is connected at one end to the bracket 61 extending from the frame 6, and at the other end to one of the drawbars, in this case the right drawbar 53.

When actuated, the side-shift cylinder moves the drawbar 53 and in turn the drum housing 23 to one side as shown by the broken outline in FIG. 2. Because of their universal connections, the lift cylinders 32, 33, and drawbars 52, 54 do not resist the side-shift movement. However, they do keep the drum axis horizontal and perpendicular to the machine centerline.

During the various adjustments effected by the lift cylinders 32 and 33, the cylinder 60 acts as a rigid member. Therefore, it is preferable to have cylinder 60 aligned between a point on the drawbar 53 and a point on the frame lying along a theoretical line between sockets 48 and 49. Ideally the forward end of cylinder 60 would be connected to the bracket 56 rather than bracket 61. This arrangement would preclude the cylinder 60 from causing any side shift of the cutting unit 5 when it is raised or lowered. However, the negligible side-shift affect of the cylinder 60 when mounted as shown in this case is more than offset by the advantage of using a shorter cylinder.

It should be noted that the suspension system just described leaves the back side of the cutting unit 5 unobstructed. By leaving one side of the drum housing open the cutting drum 21 is readily accessible for servicing, repair, or replacement, and for the quick replacement of worn bits.

In addition the triangular arrangement of the three parallel drawbars 52, 53, and 54 controls and maintains the desired orientation of the cutting unit 5, and more particularly the drum housing 23 when the position of the unit is adjusted. This is best understood by referring to the schematic diagrams of FIGS. 5 and 6 in which the numerals refer to the schematic equivalents of the components from FIGS. 1–4.

Figure 5:
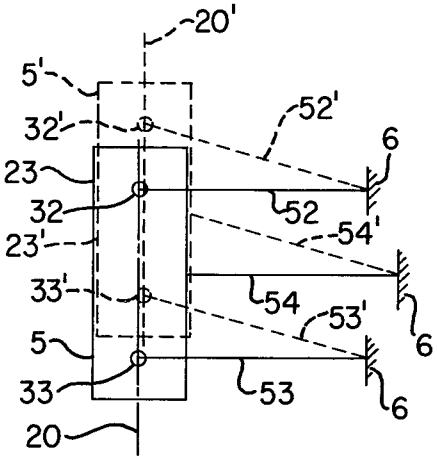
FIG. 5 is a schematic diagram illustrating the affect of the suspension system when the cutting unit is shifted sideways.

Referring to FIG. 5, when the cutting unit is shifted to one side, as shown by the broken outline, the drawbars 52 and 53 co-operate with the housing 23 and the chassis frame 6 to form a parallel four-bar linkage which keeps the axis 20 of the cutting unit parallel to its original position. It will be noted that the lower drawbar 54 also forms a parallel four-bar linkage with either of the other two drawbars which, although superfluous for this particular action, has no deleterious affect.

Figure 6:
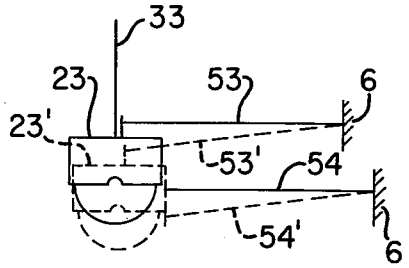
FIG. 6 is a schematic diagram illustrating the affect of the suspension system when the cutting unit is raised or lowered.
Figure 4:
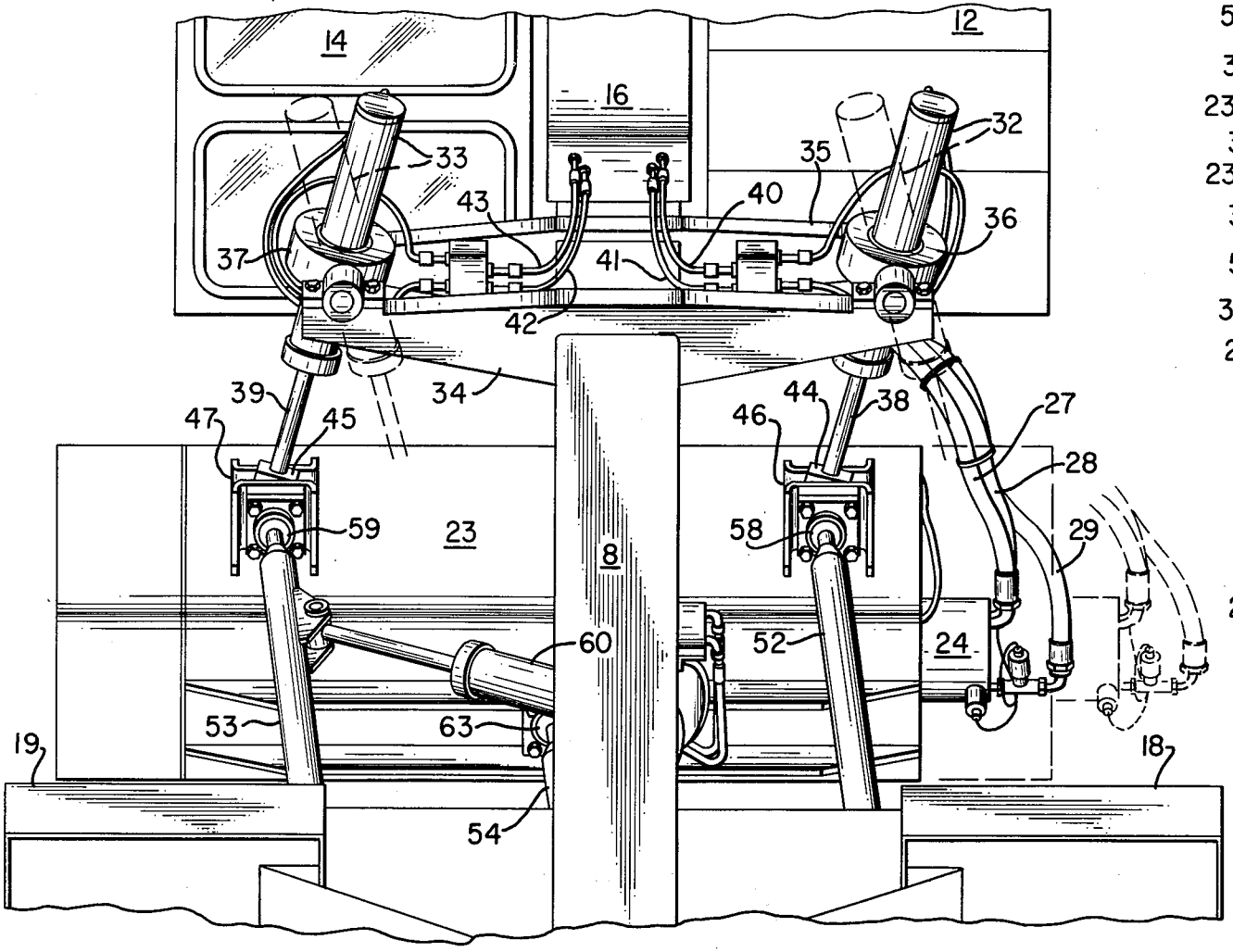
FIG. 4 is an enlarged view showing the improved suspension system for the cutting unit incorporated in the road planer of FIGS. 1-3, and is taken at an angle as shown by the lines 4—4 in FIG. 1.

Referring next to FIG. 6, when the cutting unit is raised or lowered, the lower drawbar 54 co-operates with either the right or left drawbar 53 or 52, respectively, and the housing 23 and frame 6 to form another parallel four-bar linkage which keeps the housing 23 from tilting or rotating even slightly about the drum axis.

This is an important feature of the invention since it makes the use of contemporary automatic grade controls feasible. A typical grade control has a shoe or skid rigidly attached from the end of the housing 23 such that it rides along the unplaned surface. Means are provided to sense when the skid rises or falls with respect to the vehicle frame. The sensing means sends a signal to the hydraulic system which in turn actuates one or both lift cylinders to adjust the depth of cut of the drum 21 accordingly. If the drum housing 23 is allowed to tilt about the axis 20, the attached skid will be skewed and will give an inaccurate indication of grade. However, with the orientation control provided by the described suspension system, the housing 23 is always properly oriented.

Although as shown in the drawings and described above, the cutting unit 5 is located generally centrally between the front and rear wheels 2 and 4 respectively, and with the drawbars 52, 53, and 54 extending toward the front of the vehicle, other arrangements will occur to those skilled in the art. It is readily conceived that the drawbars could extend from the back of the cutting unit, leaving the front of the housing 23 open for access. Similarly, the cutting unit could be located ahead of the front wheels or behind the rear wheels with appropriate modifications to the vehicle frame. However, all factors considered, the position of the cutting unit and drawbars as shown is deemed advantageous for purposes of operator visibility and control, and the application of chassis weight directly over the cutting unit. This particular arrangement also permits the use of shorter drawbars and in turn a shorter vehicle wheelbase for maneuverability than other arrangements considered.

In addition to the other advantages and features of the road planer and cutting unit suspension system already discussed, its simplicity makes it economical to manufacture and assemble.

The embodiments of the invention in which an exclusive property or privilege is claimed are defined as follows:

1. A road planing machine having a chassis mounted for travel on mobile ground engaging means and a rotary cutter rotatably mounted for operation on a generally horizontal axis in a housing supported from the chassis, wherein said cutter is adapted to mill away the hardened paved surface over which the planer moves, and having an improved suspension for said cutting unit, comprising:

means connected to the chassis and to the cutter housing effective to support the rotary cutter and housing and under control of the operator to raise, lower, or tilt the axis of the rotary cutter; and cutter and housing orientation control means consisting of three generally parallel and triangularly arranged inextensible drawbars each connected at one end to the cutter housing and at its other end to the chassis such that said arrangement of drawbars is effective to maintain the transverse axial alignment of the rotary cutter and to prevent any rotation of the housing about the axis of the cutter when any of the adjustments to the cutting unit are made by the support means.

2. A road planar as recited in claim 1, wherein said suspension further includes:

an extendable member connected at one end to the chassis frame and at the other end to one of said drawbars and effective when actuated by the operator to pivot said drawbar and thereby shift the rotary cutter generally along its axis and transverse to the longitudinal center line of the road planer.

3. A road planer as recited in claim 2, wherein said extendable member is a hydraulic cylinder.

4. A road planer as recited in claim 1, wherein said support means comprises:

two generally parallel fluid actuated lift cylinders each connected at one end to said chassis frame and at the other end to the top of the drum housing.

5. A road planer as recited in claim 4, wherein the drawbars are joined to the chassis frame by connections that allow universal motion.

6. A road planer as recited in claim 4, wherein the drawbars are joined to the cutter housing by connections which allow universal motion.

7. A road planer as recited in claim 4, wherein said fluid lift cylinders are joined to the cutter housing by connections which allow universal motion.

* * * * *